US005113761A

United States Patent [19]

Okamura

[11] Patent Number: 5,113,761

[45] Date of Patent: May 19, 1992

[54] INKING DEVICE

[75] Inventor: Yuichi Okamura, Tokyo, Japan

[73] Assignee: Kabushikigaisha Tokyo Kikai Seisakusho, Tokyo, Japan

[21] Appl. No.: 670,435

[22] Filed: Mar. 18, 1991

[30] Foreign Application Priority Data

Mar. 19, 1990 [JP] Japan ..... 2-69053

[51] Int. Cl.[5] ..... B41F 31/00

[52] U.S. Cl. ..... 101/350; 101/363; 101/364

[58] Field of Search ..... 101/350, 148, 204, 207, 101/208, 210, 330, 331, 348, 349, 355, 356, 363, 364; 118/258, 259, 262

[56] References Cited

U.S. PATENT DOCUMENTS

| | | | |
|---|---|---|---|
| 4,208,963 | 6/1980 | Dahlgren | 101/363 X |
| 4,485,132 | 11/1984 | Furuzono et al. | 118/262 X |
| 4,602,564 | 7/1986 | Sakamoto et al. | 101/363 X |
| 4,819,558 | 4/1989 | Counard | 101/350 X |
| 4,964,337 | 10/1990 | Bognar et al. | 101/350 |
| 5,033,380 | 7/1991 | Sonobe et al. | 101/350 |

FOREIGN PATENT DOCUMENTS

| | | |
|---|---|---|
| 55-93456 | 7/1980 | Japan . |
| 60-88741 | 6/1985 | Japan . |
| 63-18242 | 2/1988 | Japan . |

*Primary Examiner*—Edgar S. Burr
*Assistant Examiner*—Moshe I. Cohen
*Attorney, Agent, or Firm*—Foley & Lardner

[57] ABSTRACT

The present invention has as an object to provide an inking device which prevents the generation of vibration in rollers and is capable of supplying the amount of ink uniformly all the time to the surface of printing plate in the direction of its width. The inking device of the invention is constructed such that the distance between the bottom of the ink pan and the surface of the ink fountain roller, the distance between the surface of the ink fountain roller and the surface of the ink transfer roller and the surface of the roller next to it in the downstream direction are made smaller as the distance proceeds downstream. The ink is transferred from the upstream side to the downstream side, and during this ink transfer, the ink distribution is regulated uniformly in the direction of roller width by means of a doctor blade, etc. Further, the circumferential surface speeds of the rollers are variable, and the vibration of the inking device is prevented by matching the circumferential surface speed of the ink transfer roller to the circumferential surface speeds of the rotating rollers on the downstream side.

4 Claims, 2 Drawing Sheets

INKING DEVICE

BACKGROUND OF THE INVENTION

1. Field of the Invention

The present invention generally relates to an inking device used for printing machines. The invention is in particular related to a so-called keyless inking device for which the regulation of amount of ink supplied to the surface of a printing plate in the direction of surface width is not required, for instance, an inking device which employs so-called short ink with high viscosity such as that used for offset printing.

2. Description of the Prior Art

With conventional keyless inking devices, the ink used for them is low in viscosity, and, as a device which can handle such ink easily, a mechanism is provided by which an ink fountain roller rotates with part of its circumferential surface immersed in ink stored in an ink pan to lead out the ink from the ink pan such devices are described in Japanese Patent Laid-Open Publications: No. 55-93456, 'Ink Supplying Device for Rotary Printing Machine' (Prior Art Example 1). Further, a mechanism is provided in which ink is supplied directly onto the surface of an ink fountain roller from an ink nozzle, such as Japanese Utility Model Laid-Open Publications: No. 60-88741, 'Ink Supplying Device' (Prior Art Example 2).

In the case in which so-called short ink with high viscosity is used as for offset printing, the fluidity of ink is very low so that the adhesion of ink to the circumferential surface of the ink fountain roller is not very good, and the movement of the ink to and through an ink nozzle is difficult. Conventional inking devices are, therefore, incapable of working with this type of ink. Under the circumstances, a new keyless inking device such as described in Japanses Utility Model Laid-Open Publication: No. 63-18242, 'Ink Supplying Device', (Prior Art Example 3), which is a keyless inking device with an ink pan, has come to be used widely.

In prior art devices described above, an ink fountain roller which rotates with part of its circumferential surface in contact with the ink in the ink pan is provided. For this ink fountain roller, the blade which forms the bottom plate of the ink pan is provided with its extremity positioned against the circumferential surface of the roller to form a gap from the circumferential surface of the roller along its width, and the blade is rotatable round its supporting point so as to be completely away from the roller. Further, a stirrer is provided to stir the ink in the ink pan. The form of this inking device is a modification of a conventional inking device to be used for printing machines which employ hard ink. It has a gap which is uniform to the direction of the roller width and which is provided between the extremity of a blade of the ink pan and the roller. It is also used as a keyless inking device. The thickness of the ink film in the direction of roller width is regulated uniformly by the gap between the extremity of the blade and the roller. In addition, the ink in the ink pan is stirred to assist in stirring the ink and in improving the adhesion of ink to the surface of the roller. When it is required to clean the inside of the ink pan for replacement of the ink such as in changing ink color, it is made simple and easy to clean the ink pan in a short time by separating the ink pan from the ink fountain roller.

The keyless inking device as described in Prior Art Example 3, which has an ink pan, is useful for using short ink. In keyless inking devices, however, an ink fountain roller and an ink transfer roller (a roller to receive and give ink) are mutually in contact, and, while the ink transfer foller rotates with a circumferential speed that is substantially the same as that of the plate cylinder, the ink fountain roller rotates with a circumferential speed which is smaller than the circumferential speed of the plate cylinder divided by a number 6 or 7. With this arrangement the state of contact in rotation of the ink fountain roller and the ink transfer roller is either direct or with an ink film in between, according to the behavior of the ink that is between both rollers. With the state of contact being either direct or with an ink film in between, the forces acting on the circumferential surfaces of the ink fountain roller and ink transfer roller vary, creating problems such as the generation of vibration and/or tcrsinal vibration in both rollers.

As a result, in a keyless inking device described in Prior Art Example 3, uneveness develops in the ink transfers from the ink fountain roller to the ink transfer roller and from the ink transfer roller to a roller (doctor roller) downstream of the ink transfer roller, and the thickness of the ink film cannot be kept constant, with the result of an excess supply of ink to the surface of the printing plate surface or a short supply of ink to the surface of the printing plate surface so that it is difficult to maintain a good quality of printing. The vibrations developed in the rollers often become very noisy, often making the work environment worse, and, furthermore, there are possibilities that the vibration developed in the roller can be transmitted to the whole of the printing machine and, extended use, can develop unexpected inconveniences.

SUMMARY OF THE INVENTION

An object of the invention is to provide an inking device which employs short ink, eliminates generation of vibration in rollers, and always supplies substantially a uniform amount of ink in the direction of the total width of a roller to allow continuous provision of prints of an excellent quality.

An inking device of the present invention has a constitution in which the distance between the bottom of the ink pan and the surface of the ink fountain roller, the distance between the surface of the ink fountain roller and the surface of the ink transfer roller, and the distance between the surface of the ink transfer roller and the surface of the roller next to it in the downstream direction decreases as the ink moves downstream. The ink is transferred by those distances which becomes smaller as the ink moves downstream, and the amount of the ink on the roller is regulated uniformly in the direction of the total width of each roller.

Further, the circumferential speed of the ink transfer roller is constituted to be variable, and the generation of vibration of the device is prevented by matching the rotational circumferential speed of the ink transfer roller to the circumferential speed of the roller located downstream, next to the ink transfer roller.

DETAILED DESCRIPTION OF PREFERRED EMBODIMENT

An embodiment of the invention will be next explained with reference to the attached drawings.

Figure 1:
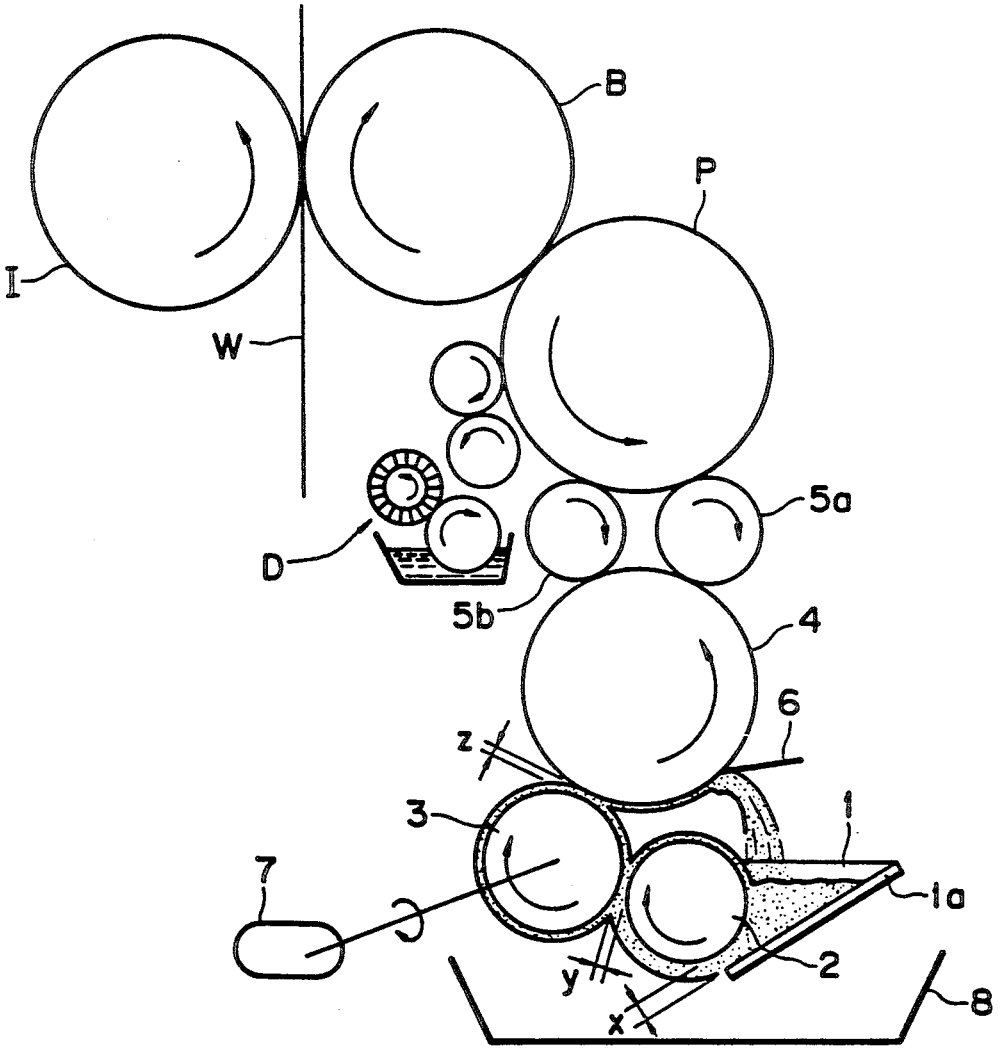
FIG. 1 is a schematic diagram showing an embodiment of the invention in which it is applied to an offset printing machine.
Figure 2:
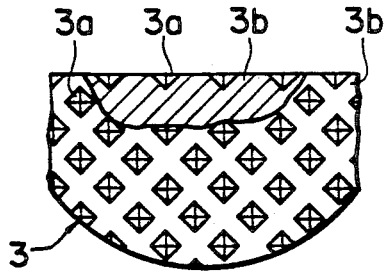
FIG. 2, FIG. 3 and FIG. 4 show ink transfer rollers of inking devices of the invention in which the circumferential surfaces are not smooth but have irregularities with dents and protrusions, the figures being enlarged in part.
Figure 3:
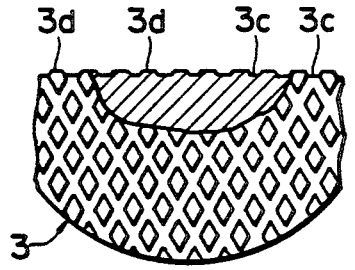
Figure 4:
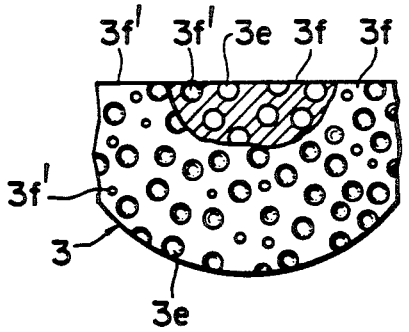
Figure 5:
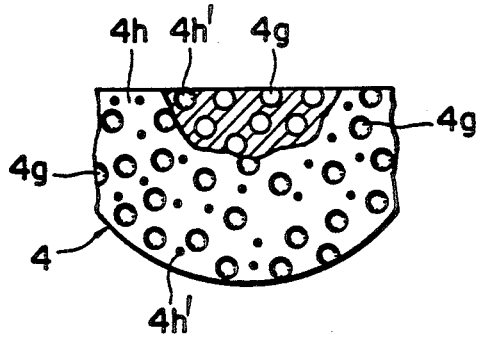
FIG. 5 is a cross-sectional view of an ink metering roller partly enlarged.

FIG. 1 shows an embodiment of the present invention, in which the invention is applied to an offset printing machine, and (1) denotes an ink pan, (2) an ink fountain roller, (3) an ink transfer roller, and (4) an ink metering roller. The ink pan (1) and ink fountain roller (2) are provided with the end of the pan bottom (1)*a* and circumferential surface of the ink fountain roller (2) positioned close to each other and the circumferential surface of the ink fountain roller (2) rotating in contact with the ink stored in the ink pan (1). At the same time at a position away from the ink fountain roller (2), as shown in FIG. 5, an ink metering roller (4) is provided. Roller (4) has on its circumferential surface many minute cavities (4)*g* for holding ink. The ink metering roller (4) is rotated substantially at a circumferential speed the same as the rotational circumferential speed of a printing plate (not shown) that is loaded on a plate cylinder P. Namely, the surface of the ink metering roller (4) consists of open minute cavities (4)*g*, a base material (4)*h* which encloses the hollow minute cavities, and exposed head sections (4)*h'* of minute hollow cavities which are not open yet. Further, on the upstream side of the ink metering roller (4), an ink transfer roller (3) is provided. The circumferential surface of the ink transfer roller (3) is close to both the circumferential surface of the ink fountain roller (2) and the circumferential surface of the ink metering roller (4). The distance Y between the circumferential surface of the ink fountain roller (2) and the circumferential surface of the ink transfer roller (3) is larger than the distance Z between the circumferential surface of the ink metering roller (4) and the circumferential surface of the ink transfer roller (3), and smaller than the distance X between the circumferential surface of the ink fountain roller (2). In addition, circumferential surface of the ink transfer roller (3) is larger than the distance Z between the circumferential surface of the ink metering roller (4) and the circumferential surface of the ink transfer roller (3), and smaller than the distance X between the circumferential surface of the ink fountain roller (2) and the extremity of the bottom (1*a*) of the ink pan (1). A doctor blade (6) is provided as a device to spread ink uniformly, and has a blade extremity contactable to the whole width of the circumferential surface of the ink metering roller (4). Ink form rollers (5)*a* and (5)*b* are also provided so as to make their respective circumferential surfaces come in contact with both the ink metering roller (4) and the above-mentioned printing plate. On the other hand, when there is a change in the state of transfer of the ink in cases such as using ink with different physical properties, a variable speed device (7) is connected to the ink transfer roller (3) in order to limit the change to a small range and maintain good state of transfer of the ink, and/or the circumferential surface of the ink transfer roller (3) is provided with dents and protrusions as shown in FIG. 2, FIG. 3 and FIG. 4. FIG. 2, FIG. 3 and FIG. 4 show examples of dents and protrusions provided on the circumferential surface of the ink transfer roller (3), with each drawing shown in cross-section and enlarged.

FIG. 2 shows an example of the dents and protrusions in which the dent is a cell (3)*a* which is sunk with a pyramid shape, and the protrusion is a straight bank (3)*b* which partitions the rows of the cells (3)*a*. FIG. 3 shows a dent formed by grooves (3)*c* which mutually intersect, and a protrusion which consists of a protrusion (3)*d* enclosed by the grooves (3)*c*. FIG. 4 shows a dent which is a hollow cavity (3)*e* formed with a minute hollow body with an opening on the surface and a protrusion which consists of the base material (3)*f* which encloses the minute hollow body and an exposed head section (3)*f'* of the minute hollow cavity which is exposed on the surface but not open yet. The dents and protrusions that are provided on the circumferential surface of the ink transfer roller (3) are not limited to the above mentioned embodiment.

The operation and actions of this invention will be explained below by way of an embodiment.

When a printing machine is started, the ink fountain roller (2) is rotated at a circumferential speed that is slower than that of the printing plate, for instance at a speed that is a speed in the order of one sixth or one seventh of the printing plate, and the ink stored in the ink pan (1) is led out from the close gap between the circumferential surface of the ink fountain roller (2) and the bottom (1)*a* of the ink pan (1) by the circumferential surface of the ink fountain roller (2). The thickness of the ink film formed on the circumferential surface of the ink fountain roller by the ink that is led out is about the same as or a little larger than the distance X between the ink fountain roller (2) and the bottom (1)*a* of the ink pan (1). The ink that is on the circumferential surface of the ink fountain roller (2) goes to the position where the circumferential surface of the ink fountain roller (2) and the circumferential surface of the ink transfer roller (3) stand opposite to each other. The ink transfer roller (3) is provided with the circumferential surface of the ink transfer roller (3) positioned close to the circumferential surface of the ink fountain roller (2) with a distance Y which is smaller than the gap y between the circumferential surface of the ink fountain roller (2) and the bottom (1)*a* of the ink pan (1). The ink on the circumferential surface of the ink fountain roller (2) is transferred from the circumferential surface of the ink fountain roller (2) to the circumferential surface of the ink transfer roller (3).

The thickness of the ink film that is transferred to the circumferential surface of the ink transfer roller (3) is about half the thickness of the ink film on the ink fountain roller (2) when the constitution of the circumferential surface of the ink transfer roller (3) and that of the ink fountain roller (2) are about the same and the circumferential surface of those rollers are about the same. However, the thickness changes with the difference of the circumferential surface constitutions of those two rollers and the difference of their circumferential speeds.

With the embodiment shown in FIG. 1, the circumferential speed of the ink transfer roller (3) can be changed from the circumferential speed that is about the same as that of the ink fountain roller (2) to the circumferential speed that is about the same as that of the printing plate by regulating a variable speed device (7). With this arrangement the amount of the ink transferred from the ink fountain roller (2) to the ink transfer roller (3) can be regulated, and it is possible to assist in maintaining favorably the balance in this amount of ink and the amount of ink that is transferred from the ink transfer roller (3) to the ink metering roller (4) that is located downstream of it. That is, as the circumferential speed of the ink transfer roller (3) is increased, the sliding of the circumferential surface of the ink fountain roller (2) increases, and on the other hand, the total amount of the circumferential surface of the ink transfer roller (3) which passes the position where the ink transfer roller (3) is opposed to the metering roller (4) increases, and the amount of the ink that goes to the position opposed to the ink metering roller (4) has the tendency to increase.

Unwanted sliding of the circumferential surface of the ink transfer roller (3) with respect to the ink on the circumferential surface of the ink fountain roller (2) is eliminated by providing the dents and protrusions on the circumferential surface of the ink transfer roller (3) and it is possible to attain the transfer of ink on the circumferential surface of the ink fountain roller (2) to the ink transfer roller (3).

The ink that is transferred to the circumferential surface of the ink transfer roller (3) goes to the position where the circumferential surface of the ink transfer roller (3) and the circumferential surface of the ink metering roller (4) are opposed by the rotation of the ink transfer roller (3). The gap between circumferential surface of the ink metering roller (4) and ink transfer roller (3) has a distance z that is smaller than the distance y between the circumferential surface of the ink fountain roller (2) and the circumferential surface of the ink transfer roller (3), and the ink that is transferred to the circumferential surface of the ink transfer roller (3) is transferred to the circumferential surface of the ink metering roller (4).

The ink that is transferred to the circumferential surface of the ink metering roller (4) goes to the position where the extremity of the doctor blade (6) makes contact by the rotation of the ink metering roller (4) and when the ink passes that position, the ink on the circumferential surface of the ink metering roller (4) is uniformly spread by the doctor blade (6) and at the same time excess ink is removed to the ink pan (1). Accordingly, the ink on the circumferential surface of the ink metering roller (4) which passes the position where the doctor blade makes contact, is mainly the ink that is stored in many minute hollow cavities (4)*g* that are provided on the circumferential surface of the ink metering roller (4) and this ink is distributed almost uniformly in the direction of the width of the ink metering roller (4).

The ink distributed substantially uniformly in the direction of the width on the circumferential surface of the ink metering roller (4) goes to the position where the ink metering roller (4) and the ink form rollers (5)*a* and (5)*b* make contact mutually, and there the ink is transferred to the ink form rollers (5)*a* and (5)*b* by further rotation of the ink metering roller (4). Then, the ink is supplied to the picture and line sections of the printing plate (not shown) that are mounted on the circumferential surface of the plate cylinder P through the ink form roller (5)*a* and (5)*b*.

The ink supplied to the picture and line sections of the printing plate is printed on a web of printing paper W introduced between a blanket (not shown) installed on the circumferential surface of a blanket cylinder B and another blanket cylinder or an impression cylinder.

Meanwhile, in FIG. 1, (D) denotes a wetting device which supplies wetting water to the printing plate in order to prevent the ink from attaching to sections which are not the sections of picture and line, and (8) is an ink receiving pan which receives ink if ink happens to drip down.

In the embodiment of the invention the generation of vibration in the ink fountain roller and ink transfer roller with the use of so-called short ink of high viscosity can be eliminated, and always a uniform amount of ink is supplied to the surface of a printing plate in the direction of its width, namely keyless ink supply is provided, and it has become possible to obtain prints of good quality continuously.

Further, since it is possible to provide keyless supply of short ink, it has become possible to use short ink that is used for ink supply that is not keyless, such as in multi-color offset printing, and now multi-color prints rich in luster are available by using the advantages of keyless ink supply.

What is claimed is:

1. An inking device including an ink fountain roller by which ink is introduced to ink rollers from an ink pan comprising an ink transfer roller provided downstream of and near said ink fountain roller with a distance between said ink transfer roller and said ink fountain roller that is smaller than the thickness of the ink film that is led out of an ink pan by said ink fountain roller, and a roller downstream of said ink transfer roller with a distance between said ink transfer roller and said downstream roller smaller than the distance between said ink transfer roller and said ink fountain roller.

2. An inking device as claimed in claim 1 wherein said ink fountain roller is rotated at a circumferential surface speed that is smaller than the circumferential surface speeds of a plate cylinder and said ink transfer roller.

3. An inking device as claimed in claim 1 wherein said ink transfer roller is connected to a variable speed device.

4. An inking device as claimed in claim 1, claim 2, or claim 3 wherein said ink transfer roller is provided with dents and protrusions on its circumferential surface.

* * * * *